US009212571B2

(12) United States Patent
Hayashi

(10) Patent No.: US 9,212,571 B2
(45) Date of Patent: Dec. 15, 2015

(54) VALVE TIMING CONTROL APPARATUS

(71) Applicant: DENSO CORPORATION, Kariya, Aichi-pref. (JP)

(72) Inventor: Masashi Hayashi, Okazaki (JP)

(73) Assignee: DENSO CORPORATION, Kariya (JP)

( * ) Notice: Subject to any disclaimer, the term of this patent is extended or adjusted under 35 U.S.C. 154(b) by 16 days.

(21) Appl. No.: 14/265,825

(22) Filed: Apr. 30, 2014

(65) Prior Publication Data

US 2014/0345550 A1 Nov. 27, 2014

(30) Foreign Application Priority Data

May 24, 2013 (JP) ..... 2013-110162

(51) Int. Cl.
*F01L 1/34* (2006.01)
*F01L 1/344* (2006.01)

(52) U.S. Cl.
CPC ..... *F01L 1/3442* (2013.01); *F01L 2001/34426* (2013.01); *F01L 2001/34433* (2013.01); *F01L 2001/34453* (2013.01)

(58) Field of Classification Search
CPC ..... F01L 1/3442; F01L 2001/34453; F01L 2001/34426
USPC ..... 123/90.15
See application file for complete search history.

(56) References Cited

U.S. PATENT DOCUMENTS

| | | | | |
|---|---|---|---|---|
| 7,487,752 | B2 * | 2/2009 | Strauss et al. | 123/90.17 |
| 2010/0175651 | A1 | 7/2010 | Takenaka | |
| 2012/0060779 | A1 | 3/2012 | Adachi et al. | |

FOREIGN PATENT DOCUMENTS

| | | |
|---|---|---|
| JP | 6-93815 | 4/1994 |
| JP | 11-141315 | 5/1999 |
| JP | 2007-255510 | 10/2007 |

OTHER PUBLICATIONS

Machine Translation of JP2007-255510 (Oct. 2007).*
Office Action (2 pages), dated Jun. 23, 2015, issued in corresponding Japanese Application No. 2013-110162 and English translation (2 pages).

* cited by examiner

*Primary Examiner* — Zelalem Eshete
(74) *Attorney, Agent, or Firm* — Nixon & Vanderhye PC

(57) ABSTRACT

A valve timing control apparatus includes a housing rotor, a vane rotor, a control valve, and a lock mechanism which locks a rotation phase at a stop time and a start time of an engine. The control valve has an atmospheric port communicating with atmosphere air; a discharge port through which hydraulic fluid is discharged from a discharge chamber communicating with the discharge port when the engine is stopped; and a check valve which intercepts the atmospheric port and the discharge port from each other by receiving a negative pressure from the discharge chamber through the discharge port when the engine is started.

5 Claims, 8 Drawing Sheets

VALVE TIMING CONTROL APPARATUS

CROSS REFERENCE TO RELATED APPLICATION

This application is based on Japanese Patent Application No. 2013-110162 filed on May 24, 2013, the disclosure of which is incorporated herein by reference in its entirety.

TECHNICAL FIELD

The present disclosure relates to a valve timing control apparatus.

BACKGROUND

Conventionally, a hydraulic valve timing control apparatus is equipped with a housing rotor rotating with a crankshaft and a vane rotor rotating with a camshaft. JP H11-141315A describes such valve timing control apparatus which controls a rotation phase of a vane rotor relative to a housing rotor by a flow of hydraulic fluid relative to an advance chamber and a retard chamber which are defined by the vane rotor inside the housing rotor.

In JP H11-141315A, the flow of hydraulic fluid is controlled by a control valve. Specifically, the control valve has a first port communicating with the advance chamber and a second port communicating with the retard chamber. When an internal combustion engine is stopped, each of the first port and the second port is made to communicate with an atmospheric port. At this time, discharge of the hydraulic fluid from an advance chamber and a retard chamber through the atmospheric port is regulated by a block valve. Therefore, at the next time of starting the engine, hydraulic fluid is immediately introduced to the retard chamber, so as to control abnormal noise caused by abnormal movement of the vane rotor. In JP H11-141315A, the rotation phase is locked at a predetermined lock phase by a lock mechanism at a time of stopping and starting the engine.

SUMMARY

It is an object of the present disclosure to provide a valve timing control apparatus in which a vane rotor is restricted from having abnormal movement and from producing abnormal noise at a time of starting an engine.

According to an aspect of the present disclosure, a valve timing control apparatus which controls valve timing of a valve opened and closed by a camshaft to which a torque is transmitted from a crankshaft in an internal combustion engine, using a pressure of hydraulic fluid, includes: a housing rotor rotating with the crankshaft; a vane rotor rotating with the camshaft, the vane rotor partitioning an advance chamber and a retard chamber in the housing rotor in a rotational direction, a rotation phase of the vane rotor relative to the housing rotor being controlled by a flow of the hydraulic fluid relative to the advance chamber and the retard chamber; a control valve which controls the flow of the hydraulic fluid relative to the advance chamber and the retard chamber; and a lock mechanism which locks the rotation phase at a stop time and a start time of the internal combustion engine. The control valve has: an atmospheric port communicating with atmosphere air; a discharge port through which the hydraulic fluid is discharged from a discharge chamber which is one of the advance chamber and the retard chamber communicating with the discharge port when the internal combustion engine is stopped, the discharge port communicating with the discharge chamber when the internal combustion engine is started; and a check valve which is able to switch the atmospheric port and the discharge port to communicate with each other or intercept from each other, the check valve intercepting the atmospheric port and the discharge port from each other by receiving a negative pressure from the discharge chamber through the discharge port when the internal combustion engine is started.

Accordingly, at the stop time of the engine, operation oil is discharged from the discharge chamber. Then, the communication between the discharge chamber and the discharge port is maintained at the next time starting the engine. If the rotation phase is unlocked by the lock mechanism accidentally at the time of starting the engine, the volume of the discharge chamber is increased by the variation torque and negative pressure occurs. Then, the check valve which receives the negative pressure through the discharge port intercepts the atmospheric port and the discharge port from each other. Due to the interception function using the negative pressure conversely, the speed and quantity of air drawn from the atmospheric port to the discharge chamber can be reduced, so it is possible to restrict the abnormal movement and noise of the vane rotor.

Moreover, the check valve makes the atmospheric port and the discharge port to communicate with each other by receiving a positive pressure from the discharge chamber through the discharge port at a time of starting the engine.

Accordingly, at the time of starting the engine, when the volume of the discharge chamber is reduced by the variation torque and positive pressure occurs, the check valve which receives the positive pressure through the discharge port communicates the atmospheric port and the discharge port with each other. Thereby, the air can be emitted into atmosphere from the atmospheric port while the positive pressure is generated, even if the small amount of air is drawn to the discharge chamber while the negative pressure is generated at the time of starting the engine. Therefore, it is possible to heighten the effect restricting the abnormal movement and sound of the vane rotor.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
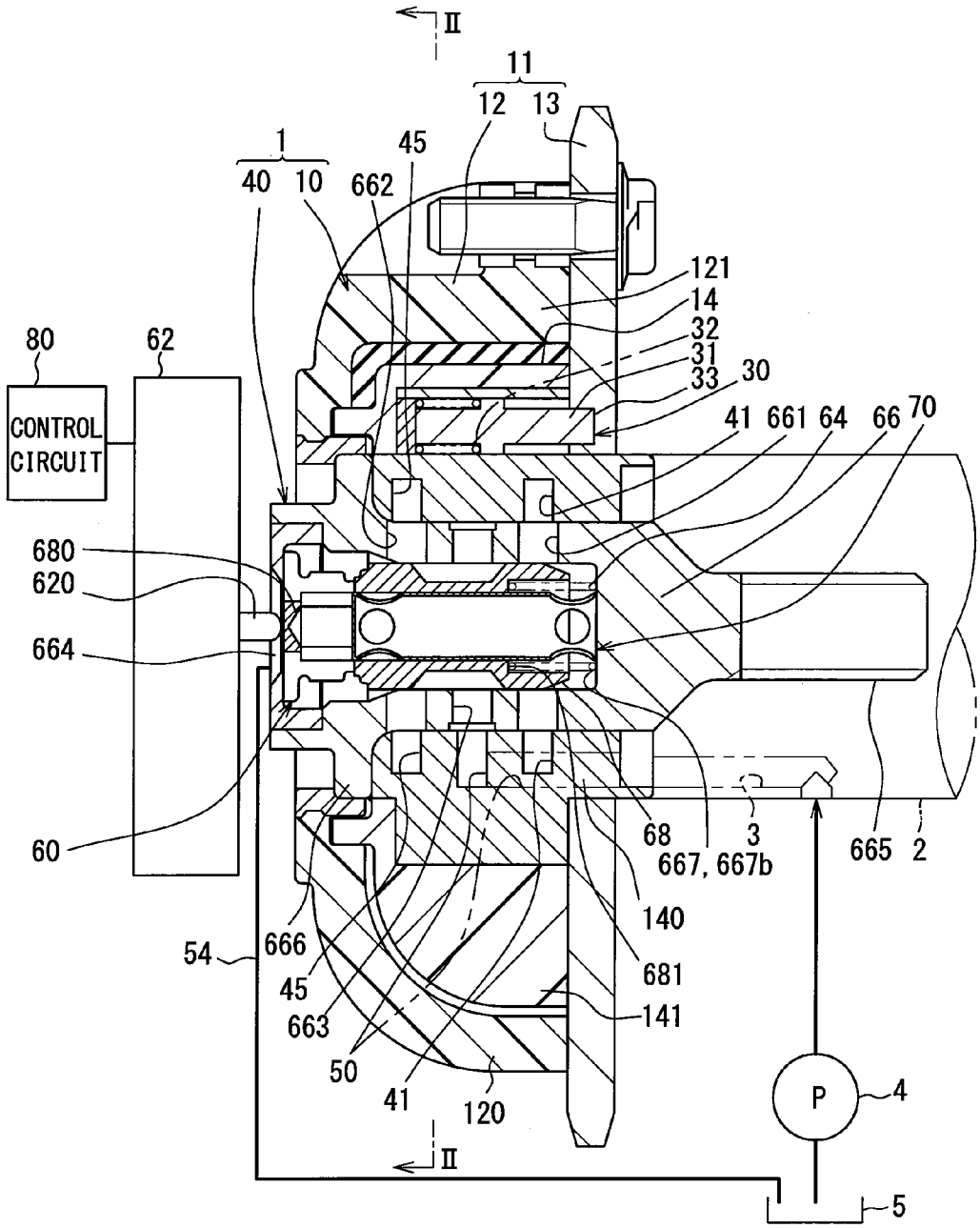
FIG. 1 is a schematic cross-sectional view illustrating a valve timing control apparatus according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

As shown in FIG. 1, a valve timing control apparatus 1 according to a first embodiment is mounted to an internal combustion engine (hereafter may be referred to as engine) of a vehicle. The valve timing control apparatus 1 is a liquid pressure type which uses a pressure of operation oil corresponding to a hydraulic fluid. The valve timing control apparatus 1 controls valve timing of an intake valve opened and closed by a camshaft 2 based on an engine torque transmitted. The valve timing control apparatus 1 includes a rotation mechanism 10 and a rotation controller 40.

Figure 2:
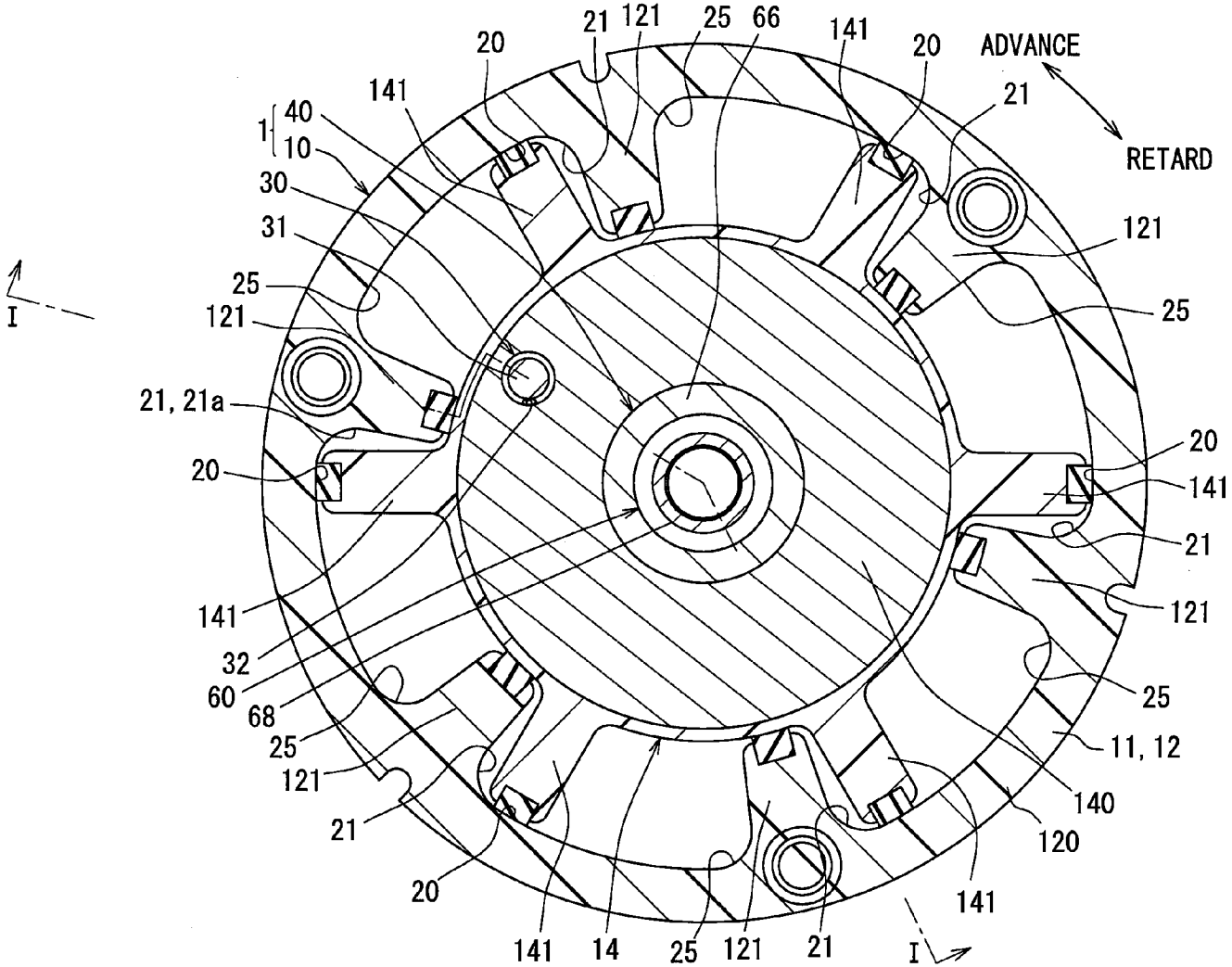
FIG. 2 is a schematic cross-sectional view taken along a line II-II of FIG. 1.

The rotation mechanism 10 is explained. The rotation mechanism 10 is installed in a channel in which the engine torque outputted from a crankshaft (not shown) is transmitted to the camshaft 2 in the internal combustion engine. As shown in FIGS. 1 and 2, the rotation mechanism 10 is equipped with a housing rotor 11 and a vane rotor 14.

The housing rotor 11 has a shoe housing 12 and a sprocket plate 13. Most of the shoe housing 12 is made of plastic material except for a metal portion. The shoe housing 12 has a main part 120 with a based cylinder shape, and plural shoes 121 with an approximately sector board shape. As shown in FIG. 2, each of the shoes 121 is projected inward in the radial direction from the main part 120, and the shoes 121 are arranged in the rotational direction with a predetermined interval. An accommodation chamber 20 is formed between the shoes 121 adjacent with each other in the rotational direction.

As shown in FIGS. 1 and 2, the sprocket plate 13 has a ring board shape covering an axial open end of the main part 120, and is made of metal. The sprocket plate 13 is engaged with the crankshaft through a timing chain (not shown). When the engine torque is transmitted to the sprocket plate 13 from the crankshaft during rotation in the internal combustion engine, the housing rotor 11 is integrally rotated with the crankshaft in a predetermined direction (counterclockwise in FIG. 2).

As shown in FIGS. 1 and 2, the vane rotor 14 is coaxially accommodated in the housing rotor 11, and has axial ends which slidingly contact the bottom wall of the shoe housing 12 and the sprocket plate 13, respectively. The vane rotor 14 has a rotation shaft 140 having a cylinder shape, and plural vanes 141 with an approximately sector board shape. The rotation shaft 140 is coaxially fixed on the camshaft 2, and is made of metal. The vane rotor 14 rotates with the camshaft 2 in the same direction as the housing rotor 11 (counterclockwise in FIG. 2), and is able to have a relative rotation relative to the housing rotor 11.

The vane 141 is made of plastic material, and is projected outward in the radial direction from the rotation shaft 140. The vanes 141 are arranged in the rotational direction with a predetermined interval. As shown in FIG. 2, each of the vanes 141 partitions the corresponding accommodation chamber 20 into the advance chamber 21 and the retard chamber 25 in the rotational direction in the housing rotor 11. In this embodiment, a plurality of the advance chambers 21 and a plurality of the retard chambers 25 are alternately formed in the rotational direction by the plural vanes 141.

As shown in FIGS. 1 and 2, the rotation mechanism 10 further includes a lock mechanism 30. The lock mechanism 30 has a lock component 31 and a lock spring 32 which are disposed in the rotation shaft 140, and a lock hole 33 defined in the sprocket plate 13.

The lock component 31 is able to fit with the lock hole 33 by a biasing force (restoring force) of the lock spring 32. The lock component 31 receives a pressure from a specific advance chamber 21*a* of the advance chambers 21. When the pressure is larger than or equal to a predetermined value, the lock component 31 is separated from the lock hole 33 against the biasing force of the lock spring 32.

The lock component 31 is fitted to the lock hole 33, when the pressure received from the advance chamber 21*a* is smaller than the predetermined value at a lock phase. At this time, the lock component 31 locks the rotation phase of the vane rotor 14 relative to the housing rotor 11 to a predetermined lock phase, e.g., a maximum retard phase of FIG. 2. When the pressure received from the advance chamber 21*a* becomes more than or equal to the predetermined value, the lock component 31 escapes from the lock hole 33, and the rotation phase is unlocked from the lock phase. In case where the pressure received from the advance chamber 21*a* is smaller than the predetermined value at a rotation phase other than the lock phase, the lock component 31 is pressed to the sprocket plate 13 by the biasing force of the lock spring 32, such that the rotation phase is maintained to be locked.

The rotation mechanism 10 controls the valve timing by controlling the rotation phase based on the flow of operation oil to the advance chamber 21 and the retard chamber 25 under the situation where the rotation phase is unlocked by the lock mechanism 30. Specifically, when the operation oil is introduced to the advance chamber 21 and is discharged from the retard chamber 25, the vane rotor 14 is rotated in the advance direction relative to the housing rotor 11. Since the rotation phase is advanced, the valve timing is advanced accordingly. When the operation oil is introduced to the retard chamber 25 and is discharged from the advance chamber 21, the vane rotor 14 is rotated in the retard direction relative to the housing rotor 11. Since the rotation phase is retarded, the valve timing is retarded accordingly.

The rotation controller 40 is explained. The rotation controller 40 controls the flow of the operation oil so as to drive the rotation mechanism 10. As shown in FIGS. 1 and 2, the rotation controller 40 has an advance passage 41, a retard passage 45, an introductory passage 50, a drain passage 54, a control valve 60, and a control circuit 80.

As shown in FIG. 1, the advance passage 41 is formed in the rotation shaft 140, and communicates with the advance chamber 21. The retard passage 45 is formed in the rotation shaft 140, and communicates with the retard chamber 25.

The introductory passage 50 is formed in the rotation shaft 140, and communicates with a pump 4 as a source of supply through a conveyance passage 3. The pump 4 is a mechanical pump driven by the engine torque during rotation in the engine, and pumps and supplies the operation oil from a drain pan 5 during the rotation. The conveyance passage 3 passes through the camshaft 2 and the bearing, and communicates with the discharge port of the pump 4. In the present embodiment, when the engine is started by cranking, the operation oil starts to be introduced from the pump 4 to the introductory passage 50. The introduction of the operation oil stops when the engine is stopped. Moreover, in a normal operation which starts from a complete in the staring operation and which stops by the stop of the engine, the pressure of the operation oil introduced from the pump 4 to the introductory passage 50 is larger than or equal to the predetermined value so as to unlock the rotation phase.

The drain passage 54 is prepared outside of the rotation mechanism 10 and the camshaft 2, and is able to communicate with atmospheric air. The drain passage 54 can discharge the operation oil to the drain pan 5.

As shown in FIGS. 1 and 2, the control valve 60 is what is called a spool valve that drives a spool 68 corresponding to a control component in a sleeve 66 corresponding to a control housing. The control valve 60 reciprocates the spool 68 in an axial direction based on a driving force generated by energizing a linear solenoid 62 shown in FIG. 1 and a biasing force (restoring force) generated in an opposite direction opposite from the driving force by elastic deformation of a return spring 64. As shown in FIG. 1, the sleeve 66 of the control valve 60 has an advance port 661, a retard port 662, an introductory port 663, and an atmospheric port 664. The advance port 661 communicates with the advance passage 41. The retard port 662 communicates with the retard passage 45. The introductory port 663 communicates with the introductory passage 50. The atmospheric port 664 communicates with the drain passage 54. The control valve 60 switches the communication state of the ports 661, 662, 663, 664 according to the position of the spool 68 in the axial direction, thereby controlling the flow of operation oil relative to the advance chamber 21 and the retard chamber 25.

The control circuit 80 is an electronic circuit including a microcomputer, and is electrically connected to the linear solenoid 62 and various electronic parts (not shown) of the engine. The control circuit 80 conducts the control of the engine, which includes the energization of the linear solenoid 62 according to a computer program stored in the internal memory.

The rotation controller 40 switches the communication state of the ports 661, 662, 663, 664 based on the control energizing the linear solenoid 62 by the control circuit 80. Thereby, the flow of operation oil to each chamber 21, 25 is controlled.

A variation torque applied from the camshaft 2 to the vane rotor 14 is explained in detail.

Figure 3:
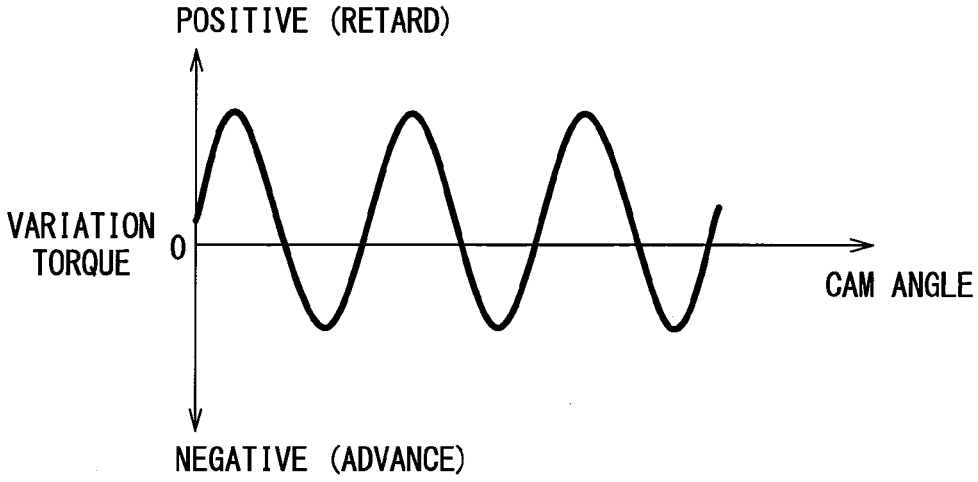
FIG. 3 is a graph illustrating a relation between a variation torque and a cam angle.

The variation torque is generated on the camshaft 2, due to the reaction force of the spring of the intake valve during rotation in the engine, and is transmitted to the vane rotor 14. As shown in FIG. 3, the variation torque fluctuates between a negative torque applied to the housing rotor 11 in the advance direction and a positive torque applied to the housing rotor 11 in the retard direction. In the variation torque of this embodiment, due to the friction between the camshaft 2 and the bearing, etc., the average torque of the positive torque and the negative torque is deviated on the positive torque (in the retard direction).

The control valve 60 is explained in detail.

Figure 4:
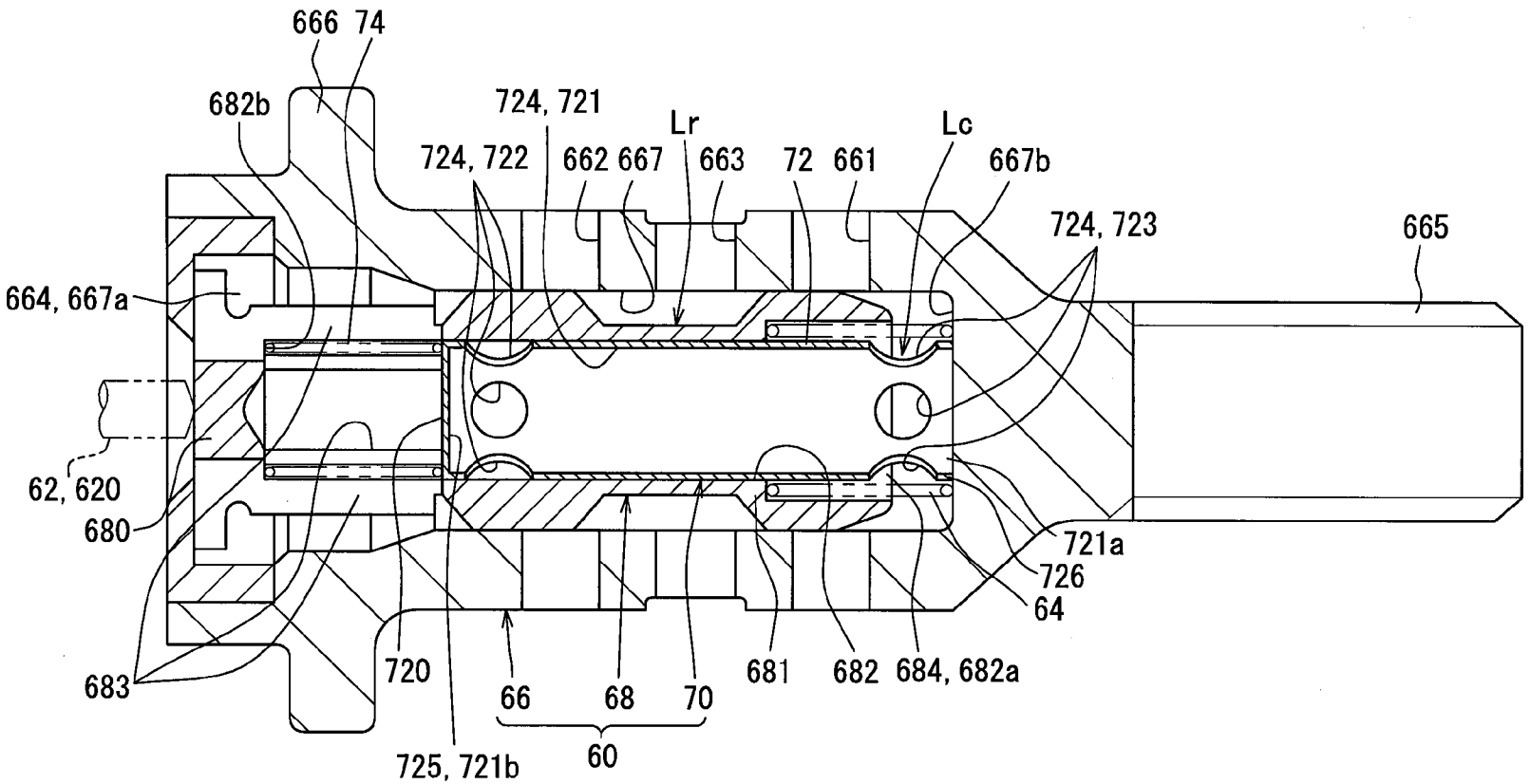
FIG. 4 is a schematic cross-sectional view illustrating a control valve of the valve timing control apparatus of the first embodiment.

As shown in FIGS. 1 and 4, the control valve 60 has a check valve 70 in addition to the sleeve 66 and the spool 68. In the following explanation, an axial direction, a radial direction, and a circumferential direction which are common for the sleeve 66 and the spool 68 are simply referred to "axial direction", "radial direction", and "circumferential direction", respectively.

The sleeve 66 made of metal and having a based cylinder shape is coaxially disposed in the camshaft 2 and the vane rotor 14 which integrally rotate with each other. The sleeve 66 extends horizontally (left-and-right direction of FIGS. 1 and 4) when the vehicle is on the horizontal surface. The sleeve 66 has a holding part 665 at the end portion in the axial direction, which is the bottom side, and a flange part 666 at the other end portion in the axial direction, which is the opening side. The holding part 665 has a male thread, and is coaxially engaged with the camshaft 2. The flange part 666 is a ring-shaped protrusion, and the rotation shaft 40 is supported in the axial direction between the holding part 665 and the flange part 666. Thus, the vane rotor 14 is fixed to the camshaft 2 in the axial direction.

As shown in FIG. 4, the sleeve 66 has a center hole 667 which is opened at the end adjacent to the flange part 666, and the other end of the center hole 667 in the axial direction is closed. The center hole 667 may be referred to as an outer accommodation hole 667. The sleeve 66 has the advance port 661, the introductory port 663, the retard port 662, and the atmospheric port 664 in this order from the holding part 665 to the flange part 666 in the axial direction. The advance port 661, the introductory port 663, and the retard port 662 are plurally formed, and have cylindrical hole shape passing through the sleeve 66 in the radial direction. The atmospheric port 664 is formed at the opening 667*a* of the outer accommodation hole 667, and is exposed to outside air (atmosphere) together with the drain passage 54 (refer to FIG. 1).

As shown in FIGS. 1 and 4, the spool 68 made of metal and having a based cylinder shape is coaxially disposed as the sleeve 66. The spool 68 is accommodated in the outer accommodation hole 667, and is able to slidingly reciprocate bothway in the axial direction. The spool 68 extends in the horizontal direction (left-and-right direction of FIGS. 1 and 4) when the vehicle is on the horizontal surface. The spool 68 has an axial contact part 680 at the end portion in the axial direction, which is the bottom side, and has a spring receive part 681 at a middle portion or the other end portion in the axial direction, which is on the opening side. The axial contact part 680 is in contact with a driving shaft 620 of the linear solenoid 62 in the axial direction. The driving shaft 620 is made of metal, and has a cylindrical shape projected into the atmospheric port 664. A return spring 64 made of metal and having a coil spring shape is supported between the spring receive part 681 and the bottom 667*b* of the outer accommodation hole 667 in the axial direction. In this state, the driving force generated to the driving shaft 620 in accordance with the electric power supplied in the linear solenoid 62 moves the spool 68 in the axial direction to a position where the driving force is balanced with the biasing force of the return spring 64 (refer to FIGS. 4-6)

As shown in FIG. 4, the spool 68 has a center hole 682 having a based cylindrical hole shape which is opened toward the bottom 667*b* in the axial direction. The center hole 682 may be referred to as an inner accommodation hole 682. The spool 68 has a radial hole 683 at an end portion or middle portion in the axial direction, and has an axial hole 684 at the other end portion in the axial direction. The radial hole 683 is plurally formed and has a rectangle hole shape passing through the spool 68 in the radial direction. The radial hole 683 is a through hole, and all the radial holes 683 communicate with outside air through the atmospheric port 664 irrespective of the position of the spool 68 shown in FIGS. 4-6. The axial hole 684 is defined by the opening 682*a* of the inner accommodation hole 682.

Figure 5:
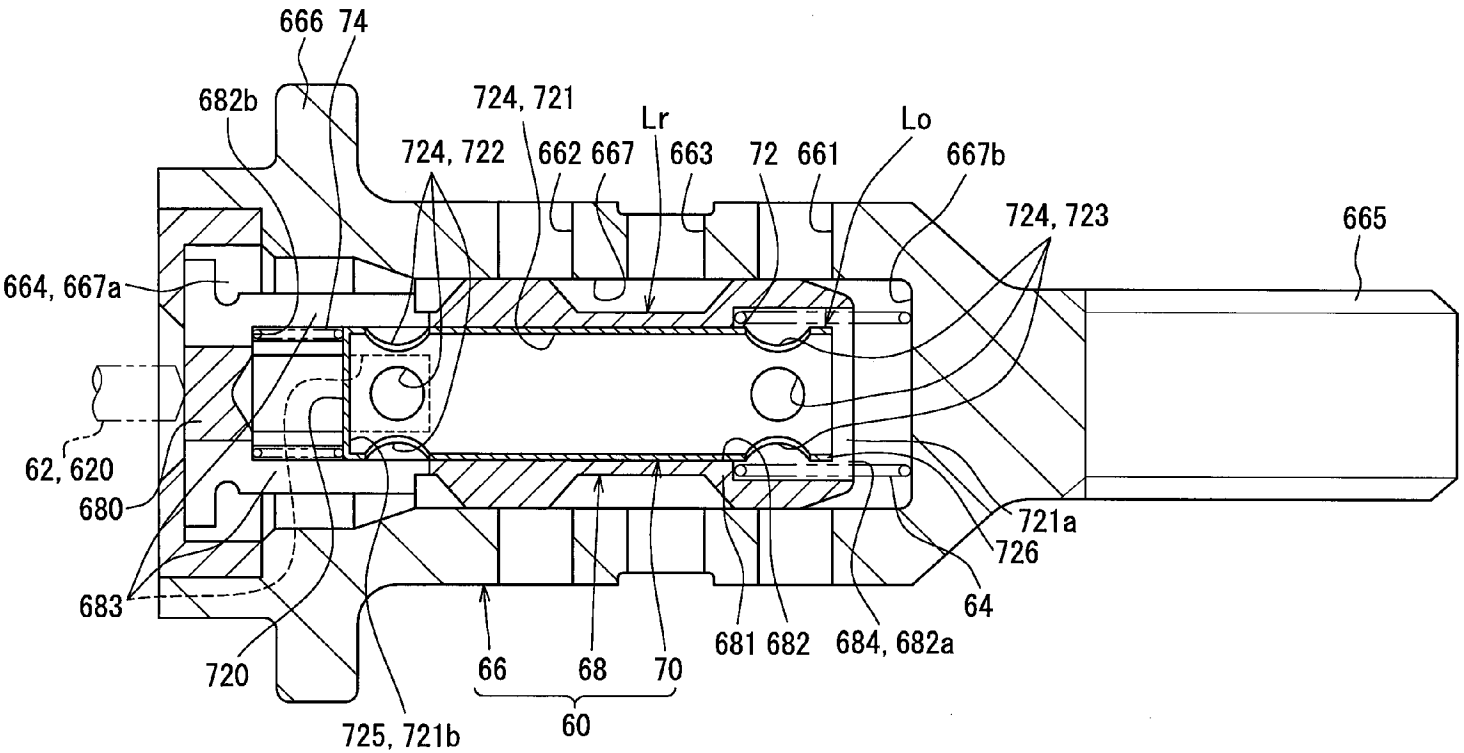
FIG. 5 is a schematic cross-sectional view illustrating the control valve of the first embodiment in an operation state different from FIG. 4.

As shown in FIG. 4, the check valve 70 has a check portion 72 and a biasing component 74. The check portion 72 made of metal and having a based cylinder shape is coaxially formed as the sleeve 66 and the spool 68. The check portion 72 is accommodated in the inner accommodation hole 682, and is able to slidingly reciprocate both-way in the axial direction. The check portion 72 extends in a horizontal direction (left-and-right direction of FIG. 4) when the vehicle is on the horizontal surface. The check portion 72 has a bottom end 720 which receives a pressure such as atmospheric pressure inputted into the outer accommodation hole 667 through the radial hole 683 communicating with outside air. Moreover, as shown in FIG. 5, an opening end 726 of the check portion 72 is distanced from the bottom 667*b* of the outer accommodation hole 667, and is able to communicate with an adjacency of the bottom 667*b*.

As shown in FIG. 4, the check portion 72 has a center hole 721 with a based cylinder hole shape which is opened toward the bottom 667*b* in the axial direction. The check portion 72 has a first radial hole 722 at an end portion in the axial direction, and has a second radial hole 723 at the other end portion in the axial direction. Each of the radial holes 722, 723 is plurally formed and has a cylinder hole shape passing through the check portion 72 in the radial direction. Each of the radial holes 722, 723 is opened to the inner circumference surface of the center hole 721.

In this embodiment, the radial holes 722, 723 and the center hole 721 correspond to a communication inner hole 724 of the check portion 72. The pressure receive part 725 of the check portion 72 is defined by the bottom 721*b* of the center hole 721 of the communication inner hole 724. When the check portion 72 is moved in the axial direction to a valve-close position Lc shown in FIG. 4 according to the pressure received by the pressure receive part 725, all the radial holes 722 are closed by the inner circumference surface of the inner accommodation hole 682, thereby the communication inner hole 724 is intercepted from the atmospheric port 664. On the other hand, when the check portion 72 is moved in the axial direction to a valve-open position Lo shown in FIG. 5 according to the pressure received by the pressure receive part 725, all the radial holes 722 can communicate with one of the radial holes 683, thereby the communication inner hole 724 can communicate with the atmospheric port 664.

As shown in FIG. 4, a biasing component 74 made of metal coil spring is coaxially disposed as the sleeve 66 and the spool 68. The biasing component 74 is accommodated in the inner accommodation hole 682 and is able to be elastically deformed in the axial direction. The biasing component 74 is supported in the axial direction between the bottom 682*b* of the inner accommodation hole 682 and the bottom end 720 of the check portion 72. The biasing component 74 generates the biasing force (restoring force) to bias the check portion 72 in the axial direction. Thereby, at the valve-close position Lc shown in FIG. 4, the check portion 72 is pressed to be in contact with the bottom 667*b* in the sleeve 66. In contrast, at the valve-open position Lo shown in FIG. 5, the check portion 72 is separated from the bottom 667*b* against the biasing force of the biasing component 74.

When a negative pressure, which is smaller than atmospheric pressure applied to the bottom end 720, is applied to the pressure receive part 725 in the check valve 70, as shown in FIG. 4, the check portion 72 moves to the valve-close position Lc according to the biasing force of the biasing component 74. On the other hand, when a positive pressure, which is larger than atmospheric pressure applied to the bottom end 720 by a set difference pressure, is applied to the pressure receive part 725, as shown in FIG. 5, the check portion 72 moves to the valve-open position Lo against the biasing force of the biasing component 74. In this embodiment, the spring constant and the set load of the biasing component 74 are set smaller such that it is possible to make the check portion 72 to be in contact with the bottom 667*b* at the valve-close position Lc under the situation where the vehicle has vibration. Therefore, the check portion 72 starts to move to the valve-open position Lo when the pressure applied to the pressure receive part 725 becomes the positive pressure which is slightly larger than the atmospheric pressure.

At the valve-open position Lo shown in FIG. 5, the pressure receive part 725 receives the pressure inputted in the communication inner hole 724 through both of the opening 721*a* of the center hole 721 and the radial hole 723. In contrast, at the valve-close position Lc shown in FIG. 4, the pressure receive part 725 receives the pressure inputted in the communication inner hole 724 through the radial hole 723 under the situation where the opening 721*a* is closed. Therefore, if the check portion 72 sticks to the bottom 667*b*, the check portion 72 can move toward the valve-open position Lo because the positive pressure is applied to the pressure receive part 725 due to the radial hole 723.

In the control valve 60, the spool 68 is driven to the retard position Lr shown in FIGS. 4 and 5 when the retarding operation is performed by energizing the linear solenoid 62. The retard port 662 is intercepted relative to the advance port 661 and the atmospheric port 664 by the spool 68 at the retard position Lr, and communicates with the introductory port 663 through an axial middle portion of the outer accommodation hole 667.

Moreover, the advance port 661 is intercepted relative to the retard port 662 and the introductory port 663 by the spool 68 at the retard position Lr, and communicates with the communication inner hole 724 through an adjacency of the bottom 667*b* of the outer accommodation hole 667. As a result, when the negative pressure from the advance chamber 21 is applied to the pressure receive part 725 through the advance passage 41, the advance port 661, and the communication inner hole 724, the check portion 72 moves to the valve-close position Lc of FIG. 4. Thus, the communication inner hole 724 is closed at a position between the advance port 661 and the atmospheric port 664. That is, the check valve 70 is switched to the interception state in which the advance port 661 and the atmospheric port 664 are intercepted from each other. On the other hand, when the positive pressure from the advance chamber 21 is applied to the pressure receive part 725 through the advance passage 41, the advance port 661, and the communication inner hole 724, the check portion 72 is able to move to the valve-open position Lo shown in FIG. 5. Thus, the communication inner hole 724 is opened to outside at a position between the advance port 661 and the atmospheric port 664. That is, the check valve 70 is switched to the communicate state where the advance port 661 and the atmospheric port 664 can communicate with each other.

Figure 6:
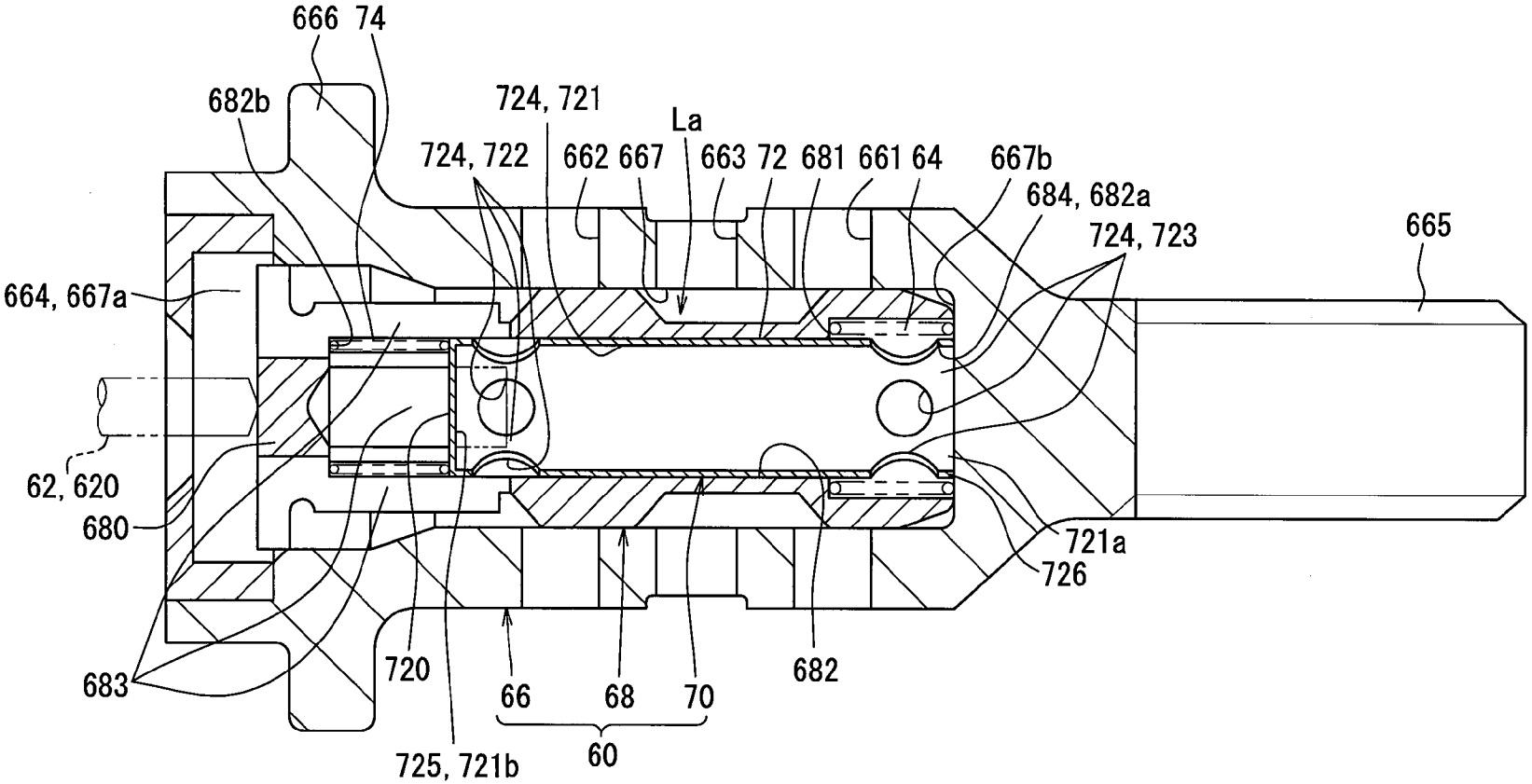
FIG. 6 is a schematic cross-sectional view illustrating the control valve of the first embodiment in an operation state different from FIGS. 4 and 5.

In contrast to the retarding operation, in an advancing operation based on the energizing of the linear solenoid 62, the spool 68 is driven to the advance position La of FIG. 6. The advance port 661 is intercepted from the retard port 662 and the atmospheric port 664 by the spool 68 at the advance position La, and communicates with the introductory port 663 through an axial middle part of the outer accommodation hole 667. Moreover, the retard port 662 is intercepted from the advance port 661 and the introductory port 663 by the spool 68 at the advance position La, and communicates with the atmospheric port 664 through an adjacency of the opening 667*a* of the outer accommodation hole 667.

Operation of the valve timing control apparatus 1 is explained in detail.

(i) In a normal operation of the engine, retarding operation or advancing operation is achieved when the control circuit 80 controls the energizing of the linear solenoid 62.

Specifically, in a retarding operation shown in FIGS. 4 and 5, operation oil pumped from the pump 4 is introduced into the retard chamber 25 communicating with the retard port 662 and the introductory port 663. At this time, the lock component 31 receives pressure from the advance chamber 21*a* and the pressure is smaller than the predetermined value, so the lock component 31 is pressed to be in contact with the sprocket plate 13 at a rotation phase other than the lock phase, thus, the unlock state of the rotation phase is maintained. Under this situation where the rotation phase continues unlocked, as the operation oil is introduced to the retard chamber 25, the volume of the advance chamber 21 is decreased. The positive pressure of the advance chamber 21 is applied to the pressure receive part 725, and atmospheric pressure is applied to the bottom end 720. As a result, since the check portion 72 moves to the valve-open position Lo of FIG. 5, the operation oil is discharged to the drain pan 5 from the advance chamber 21 communicating with the advance port 661 and the atmospheric port 664.

In the retarding operation, when the introductory pressure of the operation oil from the pump 4 is low, the pressure receive part 725 may receive a negative pressure because the negative torque of the variation torque increases the volume of the advance chamber 21 in the situation where the rotation phase is unlocked. In this case, the check portion 72 which receives atmospheric pressure at the bottom end 720 moves to the valve-close position Lc of FIG. 4, thereby temporarily stopping the discharge of operation oil from the advance chamber 21. However, since the variation torque fluctuates from the negative torque to the positive torque, the volume of the advance chamber 21 is decreased and the positive pressure acts on the pressure receive part 725. Thus, the operation oil can be intermittently discharged from the advance chamber 21.

Moreover, in the retarding operation, in case where the rotation phase is immediately advanced after reaching the maximum retard phase corresponding to the lock phase, the lock component 31 is not fitted to the lock hole 33 if the pressure received from the advance chamber 21*a* is smaller than the predetermined value, thus, the rotation phase is maintained to be unlocked. On the other hand, when the rotation phase stays at the lock phase in the retarding operation, the lock component 31 which receives pressure smaller than the predetermined value from the advance chamber 21*a* is fitted to the lock hole 33, thus, the rotation phase is locked.

In an advancing operation (refer to FIG. 6) in contrast to the above retarding operation, the operation oil from the pump 4 is introduced into the advance chamber 21 communicating with the advance port 661 and the introductory port 663. At this time, the lock component 31 which receives the pressure more than or equal to the predetermined value from the advance chamber 21*a* escapes from the lock hole 33, and maintains the unlock state of the rotation phase. Under this situation, as the operation oil is introduced to the advance chamber 21, the volume of the retard chamber 25 communicating with the retard port 662 and the atmospheric port 664 is decreased, thereby the operation oil is discharged from the retard chamber 25 to the drain pan 5.

In the advancing operation, the pressure applied to the bottom end 720 is changed. For example, the bottom end 720 may receive the positive pressure of the operation oil discharged from the retard chamber 25 through the radial hole 683. Alternatively, the bottom end 720 may receive the negative pressure from the retard chamber 25 through the radial hole 683, while the volume of the retard chamber 25 is increased by the positive torque of the variation torque, because the pressure of operation oil introduced from the pump 4 is low. However, in both the cases, the check portion 72 moves to a position corresponding to the pressure applied to the bottom end 720, and the discharge of the operation oil from the retard chamber 25 is not restricted by the check portion 72.

(ii) A normal starting operation after a normal stop is described.

The control circuit 80 starts a stop control in response to a stop instruction such as OFF instruction of an engine switch or idling stop instruction of an idling stop system while the engine is under operation. In the stop control of this embodiment, the retarding operation (see FIGS. 4 and 5) is realized before the engine is changed into an inertia rotation state. As a result, similarly to the above retarding operation (i), operation oil is introduced to the retard chamber 25 communicating with the retard port 662 and the introductory port 663, and operation oil is discharged from the advance chamber 21 communicating with the advance port 661 and the atmospheric port 664.

Therefore, the rotation phase is controlled toward the maximum retard phase corresponding to the lock phase by the operation oil introduced to the retard side and by the operation oil discharged to the advance side. When the rotation phase reaches the maximum retard phase, the pressure received from the advance chamber 21*a* by the lock component 31 becomes smaller than the predetermined value, so the lock component 31 is fitted to the lock hole 33 so as to lock the rotation phase.

Furthermore, in the stop control, the engine is in the inertia rotation state by fuel cut, thereby gradually lowering the pressure of the operation oil introduced to the retard chamber 25. Therefore, when the engine stops completely after the inertia rotation, the operation oil of the retard chamber 25 is discharged to the drain pan 5 through the pump 4.

Thus, the retarding operation (FIGS. 4 and 5) is realized in the engine which was normally stopped because the control circuit 80 starts the starting control in response to a starting instruction such as ON instruction of an engine switch or re-starting instruction of an idling stop system. As a result, operation oil starts to be introduced to the retard chamber 25 which continues communicating with the retard port 662 and the introductory port 663, and operation oil continues to be discharged from the advance chamber 21 which continues communicating with the advance port 661 and the atmospheric port 664.

At this time, the lock component 31 receives pressure from the advance chamber 21*a* and the pressure is smaller than the predetermined value. The lock component 31 continues fitting with the lock hole 33, so as to maintain to lock the rotation phase at the lock phase. In this way, when the engine perfects the ignition in the state where the rotation phase is locked, the starting operation is completed.

(iii) A fail-safe operation at a start time after an engine failure is described.

The engine may stop momentarily by abnormalities, for example, in the clutch at a rotation phase other than the lock phase. At a time of such an engine failure, similarly to the above-described retarding operation or advancing operation (i), operation oil is discharged from one of the advance chamber 21 and the retard chamber 25, and operation oil is discharged also from the other of the advance chamber 21 and the retard chamber 25 through the pump 4 to the drain pan 5. As a result, the lock component 31 is free from the pressure from the advance chamber 21*a*, and is pressed to be in contact with the sprocket plate 13, thereby maintaining the unlock state of the rotation phase.

After an engine failure at a rotation phase other than the lock phase, the retarding operation (FIGS. 4 and 5) is realized by the starting control. Thereby, similarly to the above starting control (ii), the introduction of operation oil to the retard chamber 25 is started, and operation oil continues discharged from the advance chamber 21.

At this time, the lock component 31 which receives pressure from the advance chamber 21*a* and the pressure is smaller than the predetermined value. The lock component 31 maintains to be in contact with the sprocket plate 13 at a rotation phase other than the lock phase. As a result, while the rotation phase is accidentally or erroneously unlocked, the volume of the advance chamber 21 is increased by the negative torque, and the negative pressure acts on the pressure receive part 725. Therefore, since the check portion 72 which receives atmospheric pressure at the bottom end 720 moves to the valve-close position Lc of FIG. 4, the negative pressure applied to the atmospheric port 664 is regulated. Moreover, if the variation torque is changed from the negative torque to the positive torque while the rotation phase is unlocked, the volume of the advance chamber 21 is decreased, and the positive pressure acts on the pressure receive part 725 because air is discharged. Therefore, since the check portion 72 which receives atmospheric pressure at the bottom end 720 moves to the valve-open position Lo of FIG. 5, it is allowed that the positive pressure is applied to the atmospheric port 664.

Thus, the negative pressure is regulated and the positive pressure is allowed as a fail-safe operation, and suction of air which goes to the advance chamber 21 from the atmospheric port 664 is regulated. In this way, while the air suction to the advance chamber 21 is restricted, the rotation phase reaches the maximum retard phase corresponding to the lock phase by the variation torque deviated on the positive torque side (retard side) on the average. At this time, since the pressure received by the lock component 31 from the advance chamber 21*a* is smaller than the predetermined value, the lock component 31 locks the rotation phase by fitting with the lock hole 33. Therefore, the starting operation of the engine completes at the locked state.

(iv) A fail-safe operation at an abnormal start time is described.

At a time of starting the engine which was normally stopped by the same stop control as the above normal starting operation (ii) after a normal stop, so much air may be introduced from the pump 4 to the retard chamber 25 instead of operation oil by the starting control. At the time of such an abnormal starting, the air introduced to the retard chamber 25 is further introduced into the advance chamber 21 from the gap between the rotors 11 and 14. In this case, the lock component 31 may receive a pressure more than or equal to the predetermined value from the air in the advance chamber 21*a*. In this case, if the lock component 31 escapes from the lock hole 33, the rotation phase is unlocked erroneously and accidentally at too early stage.

However, even if the rotation phase is unlocked in this way, suction of the air from the atmospheric port 664 to the advance chamber 21 is controlled by the same fail-safe operation as the above fail-safe operation (iii) at a start time after an engine failure. Moreover, at this time, since the air in the advance chamber 21 is discharged from the atmospheric port 664 by the positive torque, the pressure received by the lock component 31 from the advance chamber 21*a* becomes smaller than the predetermined value, so the rotation phase is again locked. As a result, the starting of the engine is completed in the state where the rotation phase is locked at the maximum retard phase corresponding to the lock phase.

Advantages of the first embodiment are explained.

In a comparative example, the abnormal movement in the vane rotor is mainly caused by the negative pressure originated from the variation torque applied to the vane rotor from the camshaft at a time of starting the engine. A block valve having a check valve function may be opened by the negative pressure. If the rotation phase is unlocked by a lock mechanism accidentally at a time of starting the engine, the volume of the advance chamber opposite to the retard chamber to which hydraulic fluid is introduced is increased by the variation torque, and negative pressure occurs in the advance chamber, so the block valve may be opened. In this case, air is drawn from the atmospheric port into the advance chamber, and the vane rotor has abnormal movement to collide with the housing rotor, so abnormal noise may be generated.

In addition, the rotation phase is unlocked accidentally, for example, in case of engine failure in which the engine stops momentarily after the rotation phase is deviated from the lock phase or in case where the lock mechanism unlocks the rotation phase at a time of starting the engine by air introduced to the advance chamber or retard chamber.

According to the first embodiment, when the engine is stopped, operation oil is discharged from the advance chamber 21 communicating with the advance port 661. Further, when the engine is started from the stop state, the communication state is maintained between the advance chamber 21 and the advance port 661. At this starting time, if the rotation phase is accidentally or erroneously unlocked by the lock mechanism 30, the volume of the advance chamber 21 is increased by the variation torque and the negative pressure occurs. Then, the check valve 70 which receives the negative pressure through the advance port 661 intercepts the atmospheric port 664 and the advance port 661 from each other. Thus, the speed and quantity of air introduced into the advance port 661 through the atmospheric port 664 can be reduced by the interception function using the negative pressure conversely, so the vane rotor 14 is restricted from having abnormal movement and the abnormal noise can be reduced.

According to the first embodiment, at a time of starting the engine, when the volume of the advance chamber 21 is reduced by the variation torque, and when the positive pressure occurs, the check valve 70 which receives the positive pressure through the advance port 661 communicates the atmospheric port 664 and the advance port 661 with each other. Thereby, even if the small amount of air is drawn to the advance chamber 21 at a time when the negative pressure is generated while the engine is started, the drawn air can be emitted to atmosphere from the atmospheric port 664 at a time when the positive pressure is generated. Therefore, it is possible to heighten the effect controlling the abnormal movement of the vane rotor 14 and the abnormal noise.

According to the first embodiment, the check portion 72 coaxially accommodated in the spool 68 receives the negative pressure from the advance chamber 21 at the pressure receive part 725, and moves to the valve-close position Lc in the axial direction, such that the communication inner hole 724 can be closed to intercept the atmospheric port 664 and the advance port 661 from each other. Thereby, the structure can be simplified in which the cylindrical check portion 72 having the pressure receive part 725 and the communication inner hole 724 is arranged in the cylindrical spool 68, such that the abnormal movement of the vane rotor 14 and the abnormal noise are controlled.

According to the first embodiment, in the spool 68 coaxially accommodated in the based cylindrical sleeve 66, the check portion 72 is biased by the biasing component 74 in the spool 68 in the axial direction, and is made to be in contact with the bottom 667*b* in the sleeve 66 at the valve-close position Lc. Thereby, at a time of starting the engine, the biasing force of the biasing component 74 is added to the driving force that is applied to the check portion 72 receiving the negative pressure from the advance chamber 21 at the pressure receive part 725. Thus, the check portion 72 can be certainly stopped at the valve-close position Lc. Therefore, during while the negative pressure is generated to maintain the interception between the atmospheric port 664 and the advance port 661, the suction speed and the suction amount of air to the advance chamber 21 continues decreasing, such that it is possible to heighten the effect controlling the abnormal movement of the vane rotor 14 and the abnormal noise.

According to the first embodiment, since operation oil starts to be introduced to the retard chamber 25 which is opposite to the advance chamber 21 in response to starting of the engine, the oil introduction amount is especially shorted at an early stage of the starting operation (cranking operation). As a result, it becomes easy to generate the negative pressure by the increase in the volume in the advance chamber 21, however, the negative pressure is reversely used for intercepting the advance port 661 and the advance port 664 from each other, so the suction speed and the suction amount of air to the advance chamber 21 can be reduced. Therefore, the effect controlling the abnormal movement of the vane rotor 14 and the abnormal noise can be obtained even in the situation where the negative pressure is easily generated in the advance chamber 21.

According to the first embodiment, the control valve 60 is disposed in the camshaft 2 and the vane rotor 14 integrally rotating, so the atmospheric port 664 of the control valve 60 can be located close to the advance chamber 21 defined in the vane rotor 14. Therefore, when negative pressure occurs in the advance chamber 21 near the atmospheric port 664, air drawn from the atmospheric port 664 will reach the advance chamber 21 easily for a short time. However, in the first embodiment in which the advance port 661 and the atmospheric port 664 are intercepted from each other by the negative pressure, the suction speed and amount of air to the advance chamber 21 can be reduced. Therefore, even in the situation where air easily reaches the advance chamber 21 in which negative pressure is generated, the effect of controlling the abnormal movement of the vane rotor 14 and the abnormal noise can be obtained.

In the first embodiment, the advance chamber 21 may correspond to a discharge chamber, and the advance port 661 may correspond to a discharge port.

Second Embodiment

Figure 7:
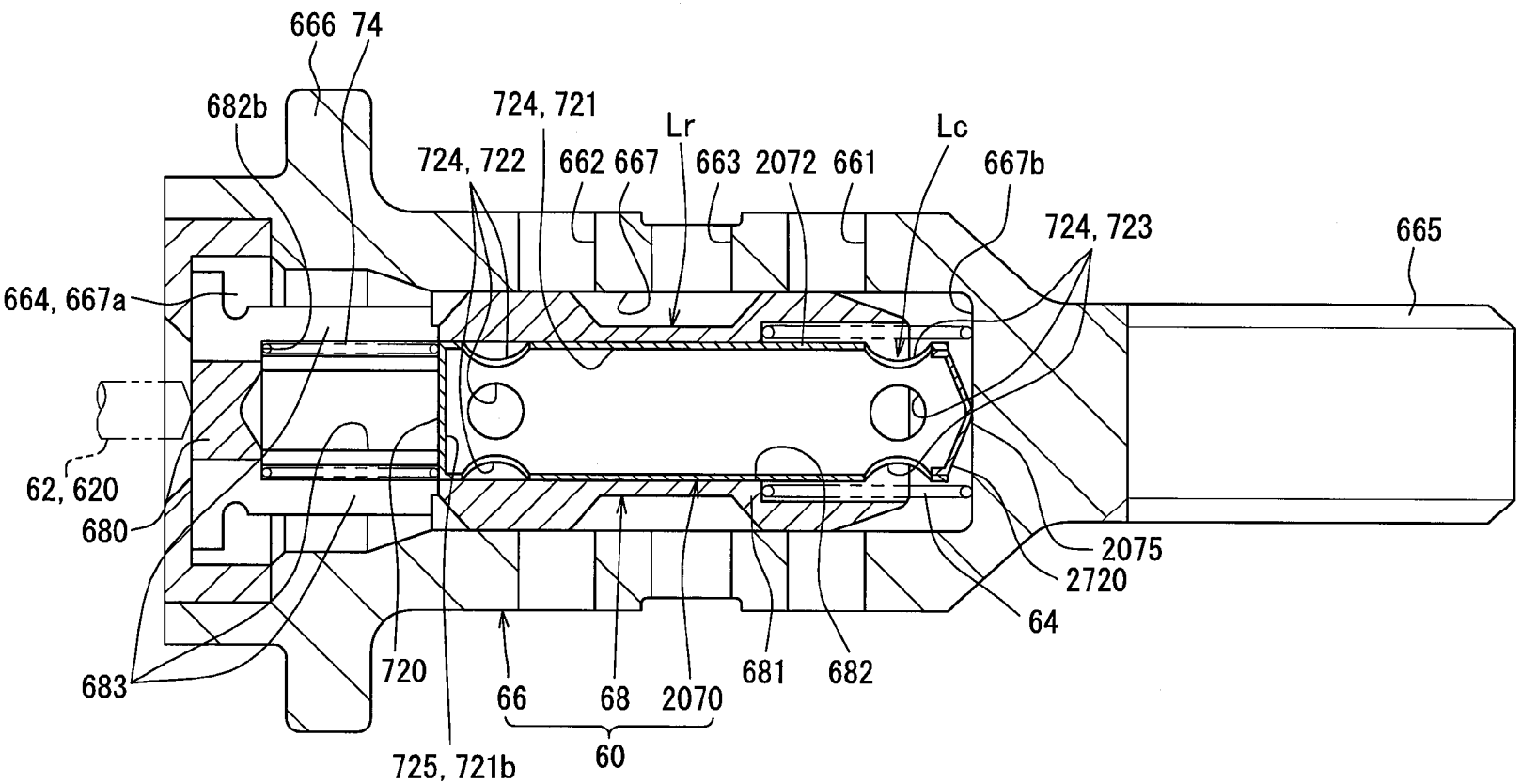
FIG. 7 is a schematic cross-sectional view illustrating a control valve of a valve timing control apparatus according to a second embodiment.
Figure 8:
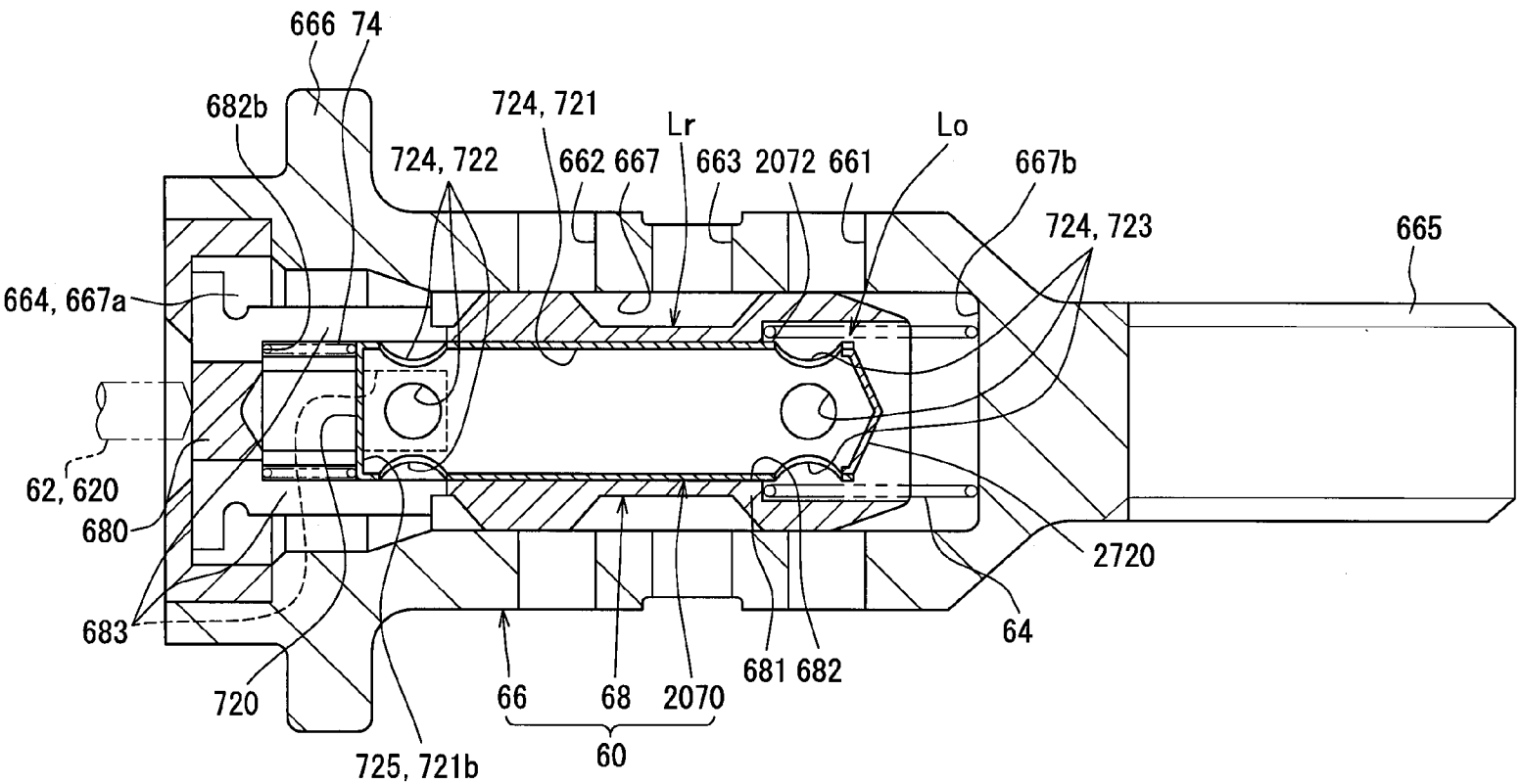
FIG. 8 is a schematic cross-sectional view illustrating the control valve of the second embodiment in an operation state different from FIG. 7.

As shown in FIGS. 7 and 8, a second embodiment is a modification of the first embodiment.

A check valve 2070 of the second embodiment has a check portion 2072 which is coaxially accommodated in the inner accommodation hole 682. The check portion 2072 has a cylinder shape, and both axial ends of the cylinder shape are closed. The check portion 2072 has a first bottom end 720 and a second bottom end 2720 opposite from each other. The diameter of the second bottom end 2720 is decreased as extending toward the bottom 667*b* of the outer accommodation hole 667. That means the second bottom end 2720 has a taper shape. The taper shape restricts the check portion 2072 from sticking to the bottom 667*b*.

The second embodiment can achieve the same operation and effect as the first embodiment.

Other Embodiment

The present disclosure is not limited to the above embodiments.

In a first modification relative to the first and second embodiments, the relation between advance and retard can be replaced (exchanged) with each other. In the case of the first modification, the retard chamber 21 corresponds to a discharge chamber, and the retard port 661 corresponds to a discharge port. In the stop control and the start control in the case of the first modification, the rotation phase may be controlled to a middle phase between the maximum advance phase and the maximum retard phase in the advancing operation, and may be controlled to the maximum retard phase in the retarding operation. In the retarding operation, the same action and effect is attained as the first and second embodiments because negative pressure occurs in the retard chamber 21 by shortage in the amount of operation oil introduced.

In a second modification relative to the first and the second embodiments, the check portion 72, 2072 may be driven only by the pressure without using the biasing component 74.

In a third modification about the first and second embodiments, the biasing component 74 may be made of other component other than the metal spring, for example, the component may be made of rubber, etc., other than the coil spring.

In a fourth modification about the first and second embodiments, the spring constant or the set load of the biasing component 74 may be relatively set larger. In this case, the ports 661, 664 may be intercepted from each other irrespective of the positive pressure applied accompanying discharge of air at a time of starting the engine. In the fourth modification, when the engine is in a normal operation, the spring constant or the set load of the biasing component 74 are set so that the ports 661, 664 can communicate with each other by the positive pressure applied accompanying discharge of operation oil.

In a fifth modification about the first and second embodiments, the pump 4 may be an electric pump. In the fifth modification, the electric pump is actuated in response to a start of the engine, so as to start the introduction of operation oil.

In a sixth modification relative to the fifth modification, regardless of the starting of the engine, the electric pump is started immediately before the starting control, so as to start the introduction of operation oil.

In a seventh modification about the first and second embodiments, the control valve 60 may be disposed inside only the camshaft 2 or the vane rotor 14.

In an eighth modification about the first and second embodiments, the control valve 60 may be arranged outside of the camshaft 2 or the vane rotor 14.

In a ninth modification about the first and second embodiments, the check valve 70, 2070 (check portion 72, 2072) may be arranged outside of the spool 68 in the sleeve 66.

In a tenth modification about the first and second embodiments, the check valve 70, 2070 (check portion 72, 2072) may be arranged outside of the sleeve 66.

In an eleventh modification about the first embodiment, it is not necessary to form the radial hole 723 of the communication inner holes 724.

In a twelfth modification about the first and second embodiments, a ring-shaped stopper may be coaxially arranged in the outer accommodation hole 667. The ring-shaped stopper may be located adjacent to the opening 667*a* away from the bottom 667*b*. The check portion 72, 2072 at the valve-close position Lc may be made to be in contact with the stopper.

In a thirteenth modification about the first and second embodiments, other type check valve such as reed valve which is opened by negative pressure may be used as long as the required function for implementation of the present disclosure is satisfied.

In a fourteenth modification about the first and second embodiments, the valve may be an exhaust valve instead of the intake valve or may be both of the intake valve and the exhaust valve.

Such changes and modifications are to be understood as being within the scope of the present disclosure as defined by the appended claims.

What is claimed is:

1. A valve timing control apparatus which controls valve timing of a valve using a pressure of hydraulic fluid, the valve being opened and closed by a camshaft to which a torque is transmitted from a crankshaft in an internal combustion engine, the valve timing control apparatus comprising:

a housing rotor rotating with the crankshaft;

a vane rotor rotating with the camshaft, the vane rotor defining an advance chamber and a retard chamber in the housing rotor in a rotational direction, a rotation phase of the vane rotor relative to the housing rotor being controlled by a flow of the hydraulic fluid relative to the advance chamber and the retard chamber;

a control valve which controls the flow of the hydraulic fluid relative to the advance chamber and the retard chamber; and a lock mechanism which locks the rotation phase at a stop time and a start time of the internal combustion engine, wherein the control valve has:

an atmospheric port communicating with atmosphere air;

a discharge port through which the hydraulic fluid is discharged from a discharge chamber which is one of the advance chamber and the retard chamber communicating with the discharge port when the internal combustion engine is stopped, the discharge port communicating with the discharge chamber when the internal combustion engine is started; and a check valve which is able to switch the atmospheric port and the discharge port to communicate with each other or intercept from each other, the check valve intercepting the atmospheric port and the discharge port from each other by receiving a negative pressure from the discharge chamber through the discharge port when the internal combustion engine is started, the control valve includes a control component having a cylindrical shape which is able to move in an axial direction to control the flow of the hydraulic fluid relative to the advance chamber and the retard chamber, the check valve includes a check portion having a cylindrical shape coaxially disposed in the control component, the check portion has a pressure receive part and a communication inner hole, and the check portion moves in the axial direction to a valve-close position where the communication inner hole is closed at a position between the atmospheric port and the discharge port by receiving the negative pressure from the discharge chamber at the pressure receive part.

2. The valve timing control apparatus according to claim 1, wherein the check valve communicates the atmospheric port and the discharge port with each other by receiving a positive pressure from the discharge chamber through the discharge port when the internal combustion engine is started.

3. The valve timing control apparatus according to claim 1, wherein the control valve has a control housing having a based cylindrical shape in which the control component is coaxially accommodated, the check valve has a biasing component accommodated in the control component, and the biasing component biases the check portion in the axial direction to make the check portion to be in contact with a bottom in the control housing at the valve-close position.

4. The valve timing control apparatus according to claim 1, wherein the other of the advance chamber and the retard chamber is an introductory chamber opposite to the discharge chamber, and the hydraulic fluid starts to be introduced into the introductory chamber when the internal combustion engine is started.

5. The valve timing control apparatus according to claim 1, wherein the control valve is arranged inside a rotation element which is at least one of the vane rotor and the camshaft.

* * * * *